United States Patent [19]

Ives

[11] Patent Number: 4,924,615

[45] Date of Patent: May 15, 1990

[54] DETACHABLE SLING SWIVEL RETENTION DEVICE

[76] Inventor: Robert K. Ives, 44202 SE. Warriner Rd., Corbett, Oreg. 97019

[21] Appl. No.: 363,163

[22] Filed: Jun. 8, 1989

[51] Int. Cl.[5] ..... F41C 23/02

[52] U.S. Cl. ..... 42/85; 24/2.5; 24/555; 24/573

[58] Field of Search ..... 42/85; 24/2.5, 555, 24/573; 224/150, 913

[56] References Cited

U.S. PATENT DOCUMENTS

| | | | |
|---|---|---|---|
| 944,022 | 12/1909 | Eken | 24/555 |
| 2,018,198 | 10/1935 | Baggett | 24/555 |
| 2,078,010 | 4/1937 | Meepos | 42/85 |
| 2,480,662 | 8/1949 | McKinzie | 42/85 |
| 2,656,577 | 10/1953 | Carbary | 24/573 |
| 2,679,707 | 6/1954 | Merlino | 42/85 |
| 2,771,699 | 11/1956 | Herter | 42/85 |
| 3,061,965 | 11/1962 | Lewis | 42/85 |
| 3,794,537 | 12/1972 | McKinzie | 42/85 |
| 4,454,675 | 6/1987 | Ives | 42/85 |
| 4,505,012 | 3/1985 | Johnson | 42/85 |
| 4,571,872 | 2/1986 | Johnson | 42/85 |
| 4,635,761 | 1/1987 | Smith et al. | 24/555 |

*Primary Examiner*—Charles T. Jordan

*Assistant Examiner*—Michael J. Carone

*Attorney, Agent, or Firm*—Kolisch, Hartwell & Dickinson

[57] ABSTRACT

A retention device for preventing inadvertent release of a shoulder sling from a firearm is provided in the form of a clip having first, second, third and terminal expanses that define a substantially right rectangle and surround the body and gate of the detachable assembly when the gate is in its closed position relative to the body. In the preferred embodiment of the invention, the clip is generally U-shaped, with a first planar expanse joining the second and third planar expanses that extend in the same direction therefrom, with the first expanse having a hole formed therein for receiving therethrough the depressible plunger of the detachable assembly. Preferably the clip is integrally formed and its resilience permits the beveled, free ends of the second and third expanses temporarily to be wedged apart as the clip is installed on the detachable assembly. Removal of the clip requires that the free ends of the expanses be sprung apart from their secure snap-fit around the gate while the clip is urged in a direction opposite that of its installation. According to a modification, the clip is generally C-shaped, is provided with a slot in one of the expanses to receive therein the plunger, and is installed laterally.

8 Claims, 1 Drawing Sheet

DETACHABLE SLING SWIVEL RETENTION DEVICE

BACKGROUND AND SUMMARY OF THE INVENTION

This invention relates generally to retention devices for use with detachable sling swivels for firearms. More specifically, it relates to a device that easily may be installed to secure the detachable part of a sling swivel mechanism against inadvertent detachment from an anchor member mounted on a firearm.

Detachable sling swivel mechanisms represent a compromise between safety and convenience in attaching shoulder slings to firearms by reducing the possibility of inadvertent detachment of the sling from the firearm, and by permitting a user quickly to detach the same when it is so desired. Such a compromise can result in the accidental discharge of a firearm when, for example, the means for detachment inadvertently is impacted with sufficient force to open a gate that is normally in a closed position relative to the body of the detachable assembly.

One prior art solution to the security problem is described in my U.S. Pat. No. 4,454,675, in which a spring-loaded plunger, which when depressed opens the gate to permit detachment of the sling from the firearm, is modified to include a locking element in the form of a threaded sleeve member that prevents depression of the plunger by abutment with the body. Although the sleeve member described therein is inseparable from the plunger, and therefore cannot inadvertently be removed or lost, nevertheless it can migrate from a locked position in abutment with the body of the assembly to an unlocked position that permits the release of the swivel from the firearm. Thus, there still exists a risk of inadvertent detachment and potentially disastrous consequences. Moreover, it takes some time to move (by screwing) the sleeve member from its locked to it unlocked position, which may discourage even responsible users from employing the safety feature.

It is desirable to provide means for better securing a detachable sling swivel mechanism from inadvertent detachment, while facilitating—and thus encouraging—its use. Preferably, the securing means would be designed to resist the variety of forces incident upon it in normal use, which might unintentionally detach the sling from the firearm, and yet would yield readily to its intentional manipulation by a user who wishes to detach the sling from the firearm.

Accordingly, it is a principal object of the invention to provide a retention device for use with a sling swivel mechanism having a body and a gate that is pivotal into an open or closed position, the device providing improved security against inadvertent detachment of a sling from a firearm.

Another object of the invention is to provide a retention device that is easily operated to secure attachment or to permit detachment.

A further object is to provide a retention device that when installed resists detachment of the sling from the firearm under the variety of forces that might be incident upon the sling swivel mechanism when it is in normal use.

Another object is to provide a retention device that facilitates the intentional manipulation by a user quickly to detach the sling from the firearm.

Yet another object is to provide a retention device that is so secure, yet so easy to use, that it is more likely than not to be used.

Still another object of the invention is to provide a retention device of the type generally outlined above that is lightweight, durable and easily and cost-effectively manufactured.

These and other advantages and features of the invention will become more fully apparent when the detailed description is read with reference to the accompanying drawings.

DETAILED DESCRIPTION OF THE PREFERRED EMBODIMENT

Figure 1:
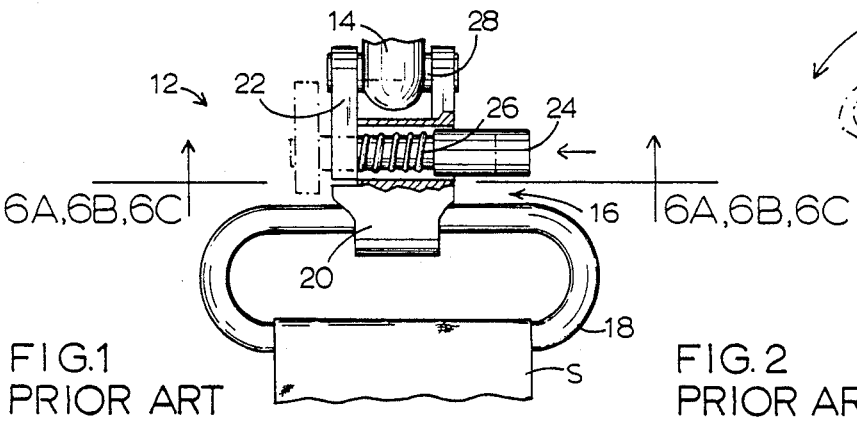
FIG.1 PRIOR ART
FIG. 1 is a front elevation of a prior art sling swivel mechanism with which the device of the invention may be used.
Figure 2:
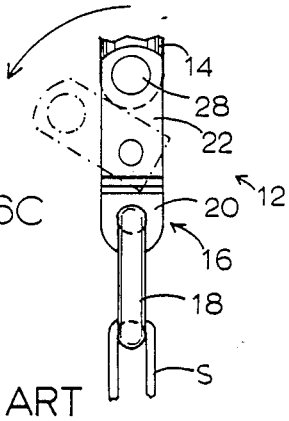
FIG. 2 PRIOR ART
FIG. 2 is a side elevation of the prior art sling swivel mechanism shown in FIG. 1.

Referring collectively to FIGS. 1 and 2, a prior art sling swivel mechanism is shown in front and side elevations and is indicated generally at 12. Mechanism 12 includes an anchor member 14 that is permanently anchored, for example, to the stock of a firearm (not shown). Mechanism 12 also includes a detachable assembly 16 having an eyelet 18, a body 20 and a pivotal gate 22. Gate 22 has an open position (shown in dash-dot lines in FIGS. 1 and 2) and a closed position (shown in solid lines in FIGS. 1 and 2), and is operable to open by depressing a plunger 24 that is loaded, or biased, against such depression, by a coil spring 26 secured within body 20. The opening of gate 22, which as illustrated requires both the depression of plunger 24 (indicated by an arrow in FIG. 1) and the pivotal rotation of gate 22 free of a projecting post 28 (indicated by an arrow in FIG. 2), permits the detachment of detachable assembly 16 from anchor member 14. A shoulder sling S extends through eyelet 18 and permits the sling swivel mechanism-equipped firearm conveniently to be transported.

Figure 3:
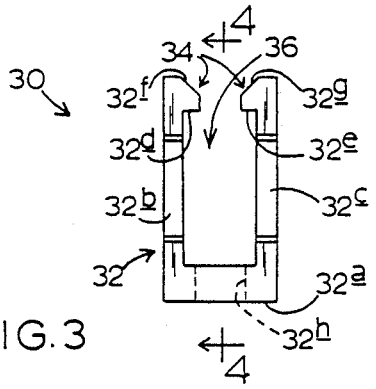
FIG. 3 is a side elevation of a retention device made in accordance with the preferred embodiment of the invention.
Figure 4:
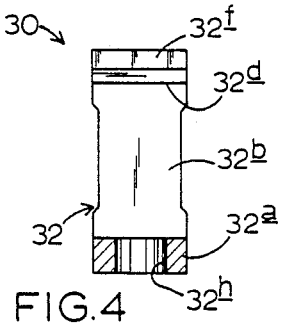
FIG. 4 is a cross-sectional, front elevation of the device, taking generally along the lines 4—4 of FIG. 3.
Figure 5:
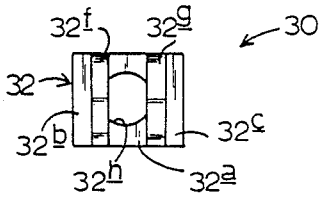
FIG. 5 is a top view of the device corresponding to FIGS. 3 and 4.

Turning now to FIGS. 3 through 5, the retention device in its preferred embodiment is shown in orthogonal views at 30. Retention device 30 may take the form of a resilient, generally U-shaped snap-fittable clip 32 integral with and operatively connected to retention means, or placement cam-surfaced locking lungs 34. Clip 32 includes a first, generally planar expanse 32*a*, which forms a region of joinder of spaced second and third planar expanses or arms 32*b*, 32*c* at first ends thereof, joined adjacent opposite, terminal edges of first expanse 32*a*. Second and third expanses 32*b*, 32*c*, extend freely from first expanse 32*a* in a first direction (up in FIG. 3) toward their laterally spaced free ends to form an open end of clip 32 opposite first expanse 32*a*. First, second and third expanses 32*a*, 32*b*, 32*c* may be seen to form a channel 36 within clip 32 that, in cross section, defines a substantially closed right rectangle. Channel 36 is dimensioned to receive therethrough body 20 and gate 22 when the latter is in its closed position (shown in solid lines in FIGS. 1 and 2).

Retention means 34 are provided, in accordance with the preferred embodiment, for detachably securing clip 32 to detachable assembly 16 and for preventing the pivoting of gate 22 into its open position (shown in dash-dot lines in FIGS. 1 and 2), when clip 32 is installed on sling swivel mechanism 12. In its preferred embodiment, retention means 34 takes the form of dual, oppositely, inwardly projecting locking lugs, or terminal expanses 32*d*, 32*e*, each of which is joined with one of the free ends of first and second expanses 32*b*, 32*c* adjacent their confronting sides. Terminal expanses 32*d*, 32*e* are placement cam-surfaced and include beveled surfaces 32*f*, 32*g*, in the preferred embodiment, which are capable during installation or placement of device 30 temporarily of urging apart the free ends of first and second expanses 32*b*, 32*c* under the influence of a force incident upon surfaces 32*f*, 32*g* in a direction opposite the direction in which expanses 32*b*, 32*c* extend from first expanse 32*a*.

Preferably, first, second, third and terminal expanses 32*a*, 32*b*, 32*c*, 32*d* 32*e*, are substantially planar as shown. Second and third planar expanses 32*b*, 32*c* are substantially parallel with one another and extend at substantially right angles from first expanse 32*a*. Terminal expanses 32*d*, 32*e* are substantially coplanar with one another, are parallel with first planar expanse 32*a* and extend at substantially right angles from second and third planar expanses 32*b*, 32*c*. First planar expanse 32*a* has formed, preferably centrally therein, a hole dimensioned to receive plunger 24 of detachable assembly 16.

Importantly, clip 32 is integrally formed, e.g. by injection molding, of a copolymer, e.g. Celcon (available from Monsanto), which provides desirable strength, resilience and self-lubrication. By such material and construction, the free ends of second and third expanses 32*b*, 32*c* are capable of being urged apart temporarily, thereby to increase the space therebetween at the open end of clip 32 during installation and removal of the same, yet snap back to their normal configuration by the inherent resiliency of the material from which clip 32 is formed.

Figure 6A:
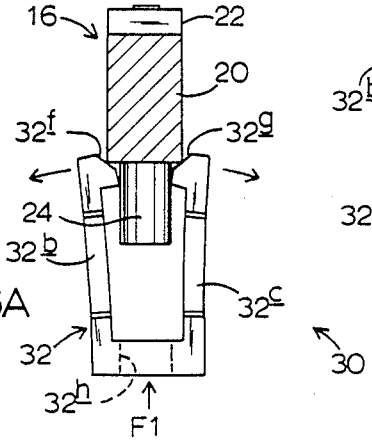
FIGS. 6A through 6C are a series of side elevations illustrating various phases of the installation and removal of the retention device from the sling swivel mechanism.
Figure 6B:
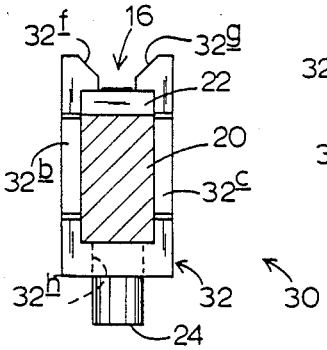
Figure 6C:
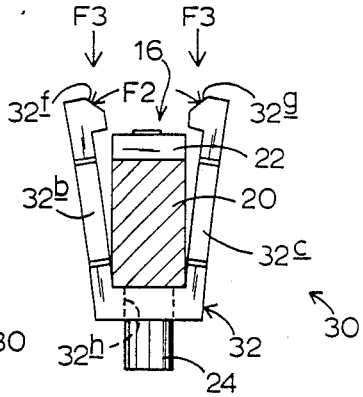

Referring next to FIGS. 6A through 6C, the installation of clip 32 on, and the removal of clip 32 from, sling swivel mechanism 12 will be described. Under the influence of a force vector F1 in the direction shown in FIG. 6A, clip 32 easily may be installed around body 20 and gate 22 of detachable assembly 16. This is accomplished by the wedging action of body 20 on beveled surfaces 32*f*, 32*g* of the free ends of second and third expanses 32*b*, 32*c*. By the continued urging of clip 32 in the direction of force vector F1 and by the introduction of plunger 24 through hole 32*h* in first expanse 32*a*, clip 32 may be made to snap-fit around body 20 and gate 22 when the latter is in its closed position as shown in FIG. 6B. Importantly, oppositely inwardly projecting terminal expanses 32*d*, 32*e* spring back to their normal position as they clear the extreme edges of gate 22, thereby capturing gate 22 in its closed position relative to body 20.

In order to remove clip 32 from detachable assembly 16, it is necessary only to urge laterally apart the free ends of second and third expanses 32*b*, 32*c*, by a force vector F2 exerted thereon in the direction indicated (by the arcuate arrows in FIG. 6C) while driving clip 32 in the direction shown by force vectors F3, a direction generally opposite that of the force required to install clip 32. The effort required to remove clip 32 from detachable assembly 16 requires only minimal digital manipulation by the user of clip 32. Yet the unique construction of clip 32 prevents inadvertent removal of clip 32 from detachable assembly 16 under the influence of random forces of the type that may be incident to normal carriage of a firearm by its shoulder sling.

It will be appreciated that clip 32 is retained in an installed, gate-capture position on detachable assembly 16 by the counterveiling, or oppositely directed, forces inherent in the disclosed structure. As is clear by reference to FIG. 6B, without the lateral urging apart of the free ends of second and third expanses 32*b*, 32*c*, clip 32 cannot be removed from detachable assembly 16. Nor will lateral forces incident upon clip 32 (forces directed into or out of the page, or to the left or right in FIG. 6B) dislodge clip 32 from its securely installed position. This in large part is due to the cooperation between plunger 24 and hole 32*h* formed in first expanse 32*a* of clip 32. So long as clip 32 is in its snap-fitted, installed position surrounding body 20 and gate 22 of detachable assembly 16 (the position shown in FIG. 6B), it is impossible to depress plunger 24 because terminal expanses 32*d*, 32*e* prevent movement of gate 22 relative to body 20 in the direction of the plunger's travel. Thus, forces incident upon plunger 24 that otherwise would result in its depression, and potentially in the opening of gate 22, are resisted by counterveiling forces imparted by clip 32 on detachable assembly 16 securely to capture gate 22 in its closed position relative to body 20.

Figure 7:
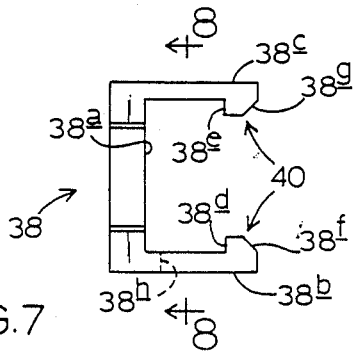
FIG. 7 is a side elevation corresponding generally to FIG. 3, but showing a proposed modification to the preferred embodiment of the invention.
Figure 8:
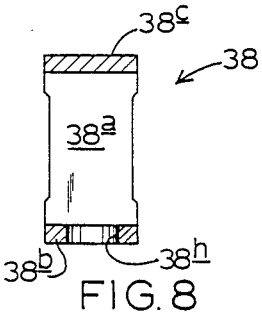
FIG. 8 is a cross-sectional, front elevation corresponding generally to FIG. 4, but showing the proposed modification.
Figure 9:
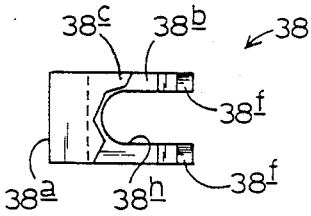
FIG. 9 is a fragmentary top view corresponding generally to FIG. 5, but showing the modification to the preferred embodiment of the invention.

Turning next to FIGS. 7 through 9, a modification to the preferred embodiment of the invention is shown, wherein a generally C-shaped retention device 38 is shown in side and front projections and in a top view corresponding generally to the preferred embodiment shown in FIGS. 3 through 5. It will be appreciated that clip 38 is quite similar to clip 32, but is installed around the body 20 and gate 22 of detachable assembly 16 laterally, rather than from the bottom, or plunger end, thereof. It will be understood that U-shaped clip 32 and C-shaped clip 38 are distinguishable primarily in their orientation relative to the longer and shorter dimensions of detachable assembly 16. Thus, the chosen "U-shaped" and "C-shaped" terminology is intended to be descriptive, rather than limitative.

Clip 38 includes a first planar expanse 38*a* forming a region of joinder between second and third expanses or arms 38*b*, 38*c* joined at first ends thereof and extending freely in a first direction from, and at right angles to, first expanse 38*a*. Second and third expanses 38*b*, 38*c* terminate in laterally spaced second free ends preferably equipped with dual, oppositely, inwardly projecting terminal expanses 38*d*, 38*e*. Beveled surfaces 38*f*, 38*g* are provided in the free ends of second and third expanses 38*b*, 38*c* to engage, respectively, body 20 and gate 22 of detachable assembly 16, thereby temporarily to urge apart the free ends that may be seen to form an open end of clip 38 opposite first expanse 38*a*. It will be appreciated that terminal expanses 38*d*, 38*e* cooperate to provide retention means 40 that, in accordance with the modification to the preferred embodiment of the invention, detachably secure clip 38 to detachable assembly 16 and prevent the pivoting of gate 22 into an open position when clip 38 is installed on sling swivel mechanism 12.

FIGS. 8 and 9 best show how clip 38 accommodates plunger 24 of detachable assembly 16 by the formation in one of the first, second or third expanses, e.g. second expanse 38*b*, of a slot 38*h* that extends through to the terminal edge of second expanse 38*b*. Those skilled in the art will appreciate that clip 38 may be installed on detachable assembly 16 in a manner that is similar to that described above in reference to clip 32: The free ends of expanses 38*b*, 38*c* temporarily may be urged apart by the impingement of bevelled surfaces 38*f*, 38*g* on body 20 and, respectively, gate 22 of detachable assembly 16 under the influence of a force incident upon clip 38 in the same direction as that in which expanses 38*b*, 38*c* extend from first expanse 38*a*. When terminal expanses 38*d*, 38*e* clear the edges of body 20 and gate 22, respectively, their free ends return by 'spring' action to their normally right rectangular cross-sectional configuration, with terminal expanses 38*e*, 38*f* retaining clip 38 substantially around body 20 and gate 22.

Removal of clip 38 from detachable assembly 16 is accomplished by urging apart the free ends of expanses 38*b*, 38*c*, while urging clip 38 in a direction opposite the extent of expanses 38*b*, 38*c* from first expanse 38*a* (to the left in FIG. 7). Thus, clip 38 is as easily and securely installed on and removed from detachable assembly 16 of sling swivel mechanism 12 as is clip 32.

In summary, clips 32, 38 are dimensioned to snap-fit substantially around body 20 and gate 22 of the detachable assembly 16 to maintain gate 22 in a closed position relative to body 20. By their unique construction, clips 32, 38 are freely drivable in one direction, e.g. the direction in which their arms extend from a region of joinder thereof, from a non-retaining position toward a retaining position relative to the detachable assembly, with the lateral spacing of the arms' free ends increasing as a consequence of the driving of clips 32, 38. By the preferred and modified embodiments of the invention, retention means 34, 40 including dual, opposing, terminal, planar expanses, e.g. expanses 32*f*, 32*g* of clip 32 and expanses 38*f*, 38*g* of clip 38 normally resist being driven, in a direction opposite that in which their arms' free ends extend from their region of joinder, from the retaining position toward a non-retaining position relative to detachable assembly 16. Thus, clips 32, 38 are drivable in the opposite direction (for removal from sling swivel mechanism 12) only under the lateral urging apart of the arms' free ends while driving clips 32, 38 in the opposite direction. It will be appreciated that, while a preferred and modified embodiment of the invention achieving these advantages are disclosed herein, other embodiments, within the spirit of the invention, also may provide for the free drivability of the clip from a non-retaining position to a retaining position while resisting drivability from a retaining position to a non-retaining position relative to the detachable assembly of a sling swivel mechanism.

Thus, the objects and advantages of the invention are realized. A lightweight, easily and inexpensively manufactured, injection molded retention device is described that easily may be installed and removed, yet it provides unprecedented security against the inadvertent detachment of a sling swivel mechanism's detachable assembly from its firearm stock-mounted anchor member. By virtue of the invention as disclosed in its preferred and modified embodiments, the risk of injury to the carrier of the firearm and others is greatly reduced.

Accordingly, while the preferred embodiment of the invention and a modification thereto have been described herein, it is appreciated that further modifications are possible that come within the scope of the invention.

What is claimed is:

1. A sling swivel retention device, adapted for removable clip-on fastening to a sling swivel mechanism, comprising:

an elongate rigid substantially non-flexing linear base;

a pair of spaced elongate flex arms joined to said base adjacent its opposite ends to form with the base a generally U-shaped structure; and placement-cam-surfaced locking lugs joined to said arms adjacent the confronting sides thereof and toward the free ends of the arms, said base and arms being so constructed that, with the device in a retention position fastened to such a swivel mechanism, external pressure applied in any direction to said base is ineffective to cause relative lateral separating movement of said arms, with consequent accidental separation of the device from the swivel mechanism.

2. For use with a sling swivel mechanism including an anchor member and a detachable assembly having an eyelet, a body and a pivotal gate, the gate having an open and a closed position and being operable to open by depressing a spring-loaded plunger secured within the body to detach the assembly from the anchor member, a retention device comprising:

a shape-retentive clip that includes a first elongate rigid expanse and spaced second and third expanses joined adjacent opposite terminal edges of said first expanse and extending therefrom in a first direction toward free ends of said second and third expanses to form an open end of said clip opposite said first expanse, said first, second and third expanses forming a channel dimensioned to receive therethrough the body and gate with the latter in a closed position, said first expanse being configured to conform substantially along its lengthwise extent to a matable surface of the detachable assembly of the sling swivel mechanism, and retention means integral with and operatively connected to said clip for detachably securing said clip to the detachable assembly and for preventing the pivoting of the gate into an open position when said clip is installed on the sling swivel mechanism.

3. The device of claim 2, wherein said first, second and third expanses are integrally formed of a resilient material such that said free ends are capable of being urged apart temporarily, thereby to increase the space therebetween at said open end of said clip during installation and removal of the same.

4. The device of claim 3, wherein said retention means includes dual oppositely inwardly projecting terminal expanses each joined with one of said free ends.

5. The device of claim 4, wherein each of said terminal expanses includes a beveled surface capable of urging apart said free ends under the influence of a force incident upon said beveled surfaces in a second direction generally opposite said first direction.

6. The device of claim 4, wherein said channel in cross section defines a substantially closed right rectangle.

7. The device of claim 2, wherein said first, second, and third expanses are substantially planar, and wherein said second and third expanses extend at substantially right angles from said first expanse.

8. The device of claim 2, wherein one of said first, second and third expanses has formed therein a hole dimensioned to receive the plunger of the detachable assembly.

* * * * *